US006427361B1

(12) United States Patent
Chou

(10) Patent No.: US 6,427,361 B1
(45) Date of Patent: Aug. 6, 2002

(54) VARIABLE RATIO CONTROL SHOE WITH AUTOMATIC TYING AND UNTYING SHOELACE

(76) Inventor: Lung Chiao Chou, No. 1, Alley 9, Lane 250, Sec 2, Cheng Gung RD., Nei Hu District (CN)

( * ) Notice: Subject to any disclaimer, the term of this patent is extended or adjusted under 35 U.S.C. 154(b) by 0 days.

(21) Appl. No.: 09/685,337

(22) Filed: Oct. 11, 2000

(30) Foreign Application Priority Data

Jul. 28, 1999 (CN) ..... 00218618 U

(51) Int. Cl.[7] ..... A43C 11/12; A43B 3/26
(52) U.S. Cl. ..... 36/50.1; 36/138
(58) Field of Search ..... 36/118.1, 50.1, 36/50.5, 138

(56) References Cited

U.S. PATENT DOCUMENTS 5,026,087 A * 6/1991 Wulf et al. ..... 36/117.1
5,175,949 A * 1/1993 Seidel ..... 36/50.5
5,791,068 A * 8/1998 Bernier et al. ..... 36/50.1
5,839,210 A * 11/1998 Bernier et al. ..... 36/50.1
5,983,530 A * 11/1999 Chou ..... 36/50.1
6,032,387 A * 3/2000 Johnson ..... 36/50.1

* cited by examiner

*Primary Examiner*—M. D. Patterson
(74) *Attorney, Agent, or Firm*—Troxell Law Office PLLC

(57) ABSTRACT

A variable ratio control shoe with automatic tying and untying shoelace, with automatic lace tying process controlled by a variable ratio control mechanism and untying process controlled by a control mechanism in the laminated layers of the shoe body, its construction comprising a set of tying component, an adjustment mechanism to adjust tension, a modulated sole lamination having at least one assembling space, and a modulated control mechanism assembled in the control groove at the rear of the outsole, to engage the tying shoelace or disengaging the shoelace to take off the shoe, having the advantages of modulated control, mass production, low waste product rate and low costs.

16 Claims, 14 Drawing Sheets

VARIABLE RATIO CONTROL SHOE WITH AUTOMATIC TYING AND UNTYING SHOELACE

BACKGROUND OF THE INVENTION

This invention of new design is a technical field of shoes, relating to a variable ratio control shoe with automatic tying and untying shoelace, particularly to a shoe with automatic tightening and releasing operation, requiring no long shoelace, while the tension of the shoelace can be adjusted by an adjustment mechanism to suit personal needs.

Shoes are a modern necessity. To ensure wearing comfort and convenience, the manufacturers have been introducing new designs as well as other fashionable performances.

In terms of convenience in putting on or taking off shoes, we have seen models of shoes with or without tying shoelace, or shoes with zippers. At the present, there is an invention invented by the subject applicant, i.e. Chinese Patent No. 97 1 06505.5(U.S. Pat. No. 5,983,530) relating to shoes with automatic shoelace tying and untying performance. In that case, it can be found that the vertical pressing of the pressing plate in that shoe patent is in proportion to the pulling and tying cord control of the shoelace. Therefore, to achieve proper tying operation of the shoelace, or relatively said pressing plate must be lifted high to achieve the tying control of the shoelace, it will only influence the integral beauty of the shoes, but will also result in inconvenience or discomfort when the user's heels must be lifted high to enable insertion of the toes into the shoes before the heels can step on the pressing plates;

Moreover, during production of the shoes, the tying mechanism, the sliding adjustment mechanism, the pressing plate and the control mechanism must be respectively installed onto the sole, and the vamp containing the shoelace be covered on the middle sole, before the sole and the middle sole care fixed together; in the shoe making industry, the fixing process of the sole and the middle sole has a certain difficulty, the processing quality will directly influence the quality of the shoes, and the individualization and exposure of various components to be assembled on the sole, the engagement of the shoelaces between the sole and the top, they all increase processing difficulties in fixing the sole and the middle sole, which could not be entered in mechanized mass production. Therefore, because it requires special manual operation, there could be relatively higher waste product rate and higher costs.

BRIEF DESCRIPTION OF THE INVENTION

The objective of this invention is to provide a type of shoes with variable ratio control of the automatic shoelace tying and untying operation, by interactive variable ratio to control the shoelace tying and untying performance, and the modulated mechanism will contribute to mass production, low waste product rate, and lower costs.

This invention is realized in the following way: A variable ratio control shoe with automatic shoelace tying and untying performance, comprising a shoe body and at least one piece of tying component, its structural characteristics including a modulated design of a variable ratio multiplex mechanism and a control mechanism, and said shoelace making self adjustment by means of an adjustment mechanism, wherein:

a. Shoe body, on two tying earpieces on the vamp, on one tying earpiece opposite the end of the shoelace and ting component is laminated to include an adjustment mechanism, the lamination on the inside of the tying earpiece on another side is at least one laminated cord accommodating channel in coordination with the eyelets, communicating with the modulated sole lamination that is installed in the variable ratio multiplex mechanism between the middle sole and the shoe pad, the extended end of the shoelace and tying component inserted in to the shoe body through the cord accommodating channel and working with the variable ratio multiplex mechanism to serve as the drive, at the rear of the outsole is a control groove containing the control mechanism:

b. At least one set of tying components, including a decorative shoelace and a shoelace cord, the fixed end of said shoelace being inserted in tying earpiece lamination, for optional engagement to the snap grades in the adjustment mechanism, to adjust the tying tension, one extended control end of the shoelace cord extending from the laminated cord accommodating channel on the vamp into the shoe body, tied to the variable ratio multiplex mechanism and driven by it to serve tying or untying performance;

c. A set of variable ratio multiplex mechanism installed between the shoe pad and the middle sole of the shoe, comprising the following:

A modulated sole lamination, easily installed between the middle sole and the shoe pad, at the laminated end of the sole is at least one assembling space groove, the cord guide block being located next to the operating space and communicating with each other, at the rear in the groove are rows of support posts, slide members and tying spots, to assemble the pressing plate and wind the shoelace cord;

A pressing plate, its connecting end directly connected to the assembling space groove of the sole lamination, at the bottom of the pressing plate pressed against by the curve arm is an insert member with its end in the formation of a snap head, when the pressing plate is pressed, it goes through the hollow channel of the sole lamination and the open hole on the middle sole, and is engaged by a control mechanism installed in the control groove on the outsole;

A curve arm, installed in the assembling space groove to match the pressing plate, under normal conditions it is pressed against by a flexible member to become curved status, the slide end of the curve arm can optionally be engaged to a pulling plate, the slide member of the pulling plate working with the slide members at the rear of the assembling space groove and the tying spots to wind the shoelace cord, forming the variable ratio control tying shoelace of the shoelace cord; and A control mechanism, opposite the insert member and assembled in the control groove of the outsole, on the rear wall of the control groove is a through hole to assemble the button, to push the snap plate inside the control box, and control the engagement or disengagement of the insert member.

This invention with its many pieces of shoelaces with variable ratio control, can be further be realized in the following way:

On the upper and lower ends of the modulated sole lamination can respectively a assembling space groove, wherein in the first assembling space groove on the upper end face, such as the aforementioned pressing plate, curve arm and pulling plates, etc. in the second assembling space groove are installed two cord guide blocks that are parallel to each other and in matching shapes, between the cord guide blocks is a clearance, to enable a shuttle plate to slide in said clearance, in the hollow long groove of the shuttle plate is a cord pulling space formed by several pulleys, respectively for the insertion of shoelace cord in relation to the cord guide block, one end of the shuttle plate is tied to a pulling cord, this pulling cord going through pulley of the sleeve at the rear of the sole lamination, entering the first assembling space groove, and winding through the slide members at the rear of the pulling plate, then tied to the ting spot and support post at the rear of the first assembling space groove, meanwhile, the total length of the pulling cord is approximately two times the total of the length of the curve arm when spread flat and the length of sleeve pulley winding between the first assembling space groove to the second assembling space groove, forming the variable ratio control interactive tying shoelace, and the interactive untying shoelace is controlled by the control mechanism.

With the adoption of the above structures, this invention has the following advantages:

Because of the shoelace cord winding on the variable ratio multiplex mechanism, the longitudinal height difference resulting from the downward pressing of the pressing plate will cause two or more than two times of control extended length variation of the shoelace cord in the assembling space groove, enabling the cycle and disengagement control required by automatic tightening of the shoelace under short-distance interactive movement of the shoelace; the components can be more conveniently assembled due to their modulated design, enabling easy mass production, low waste rate and low costs.

BRIEF DESCRIPTION OF DRAWINGS

The drawings of preferred embodiments of this invention are described in details as follows to enable better understanding.

DETAILED DESCRIPTION OF PREFERRED EMBODIMENTS

Figure 1:
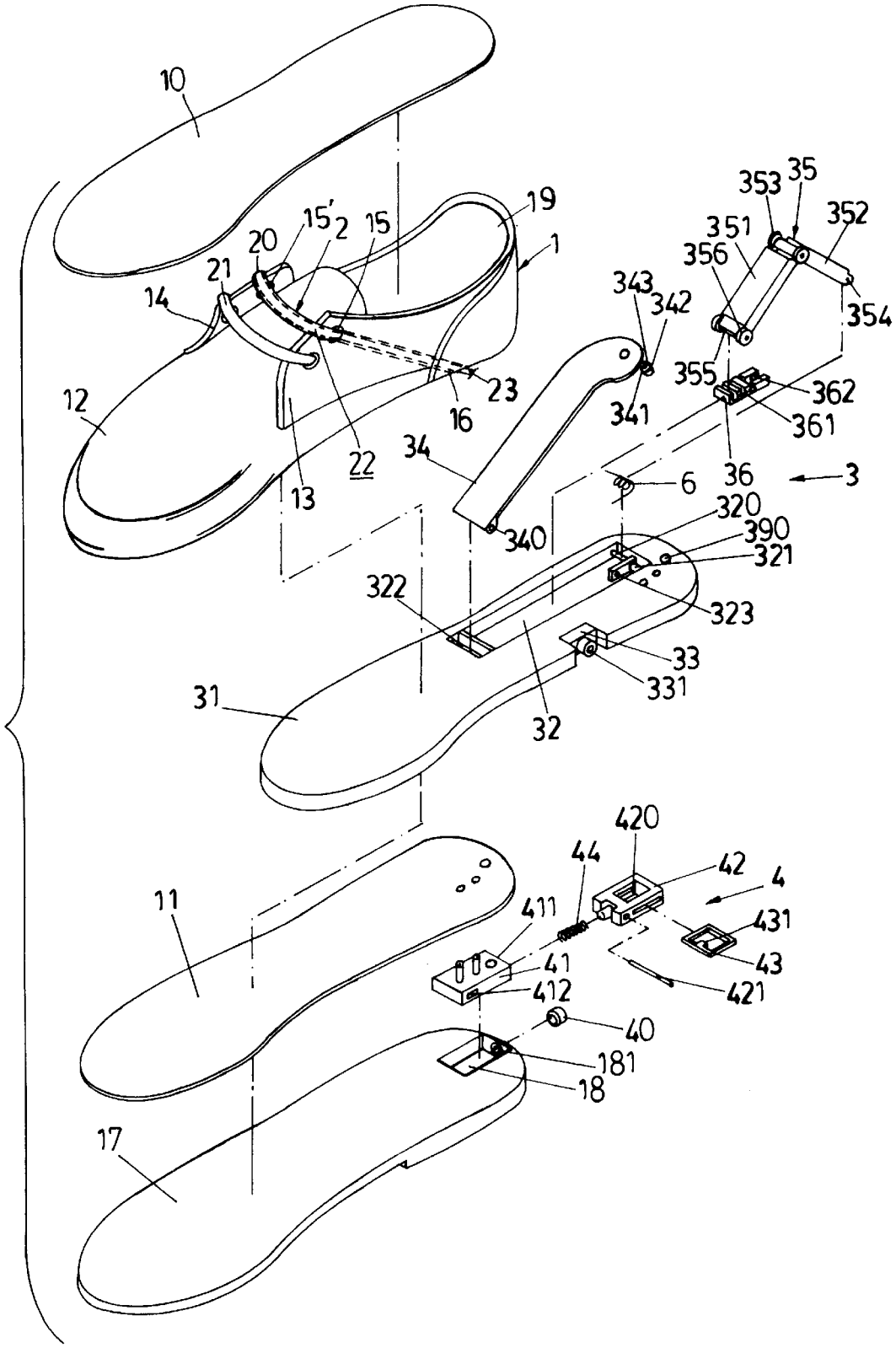
FIG. 1 is an exploded view of the first embodiment of this invention.
Figure 2:
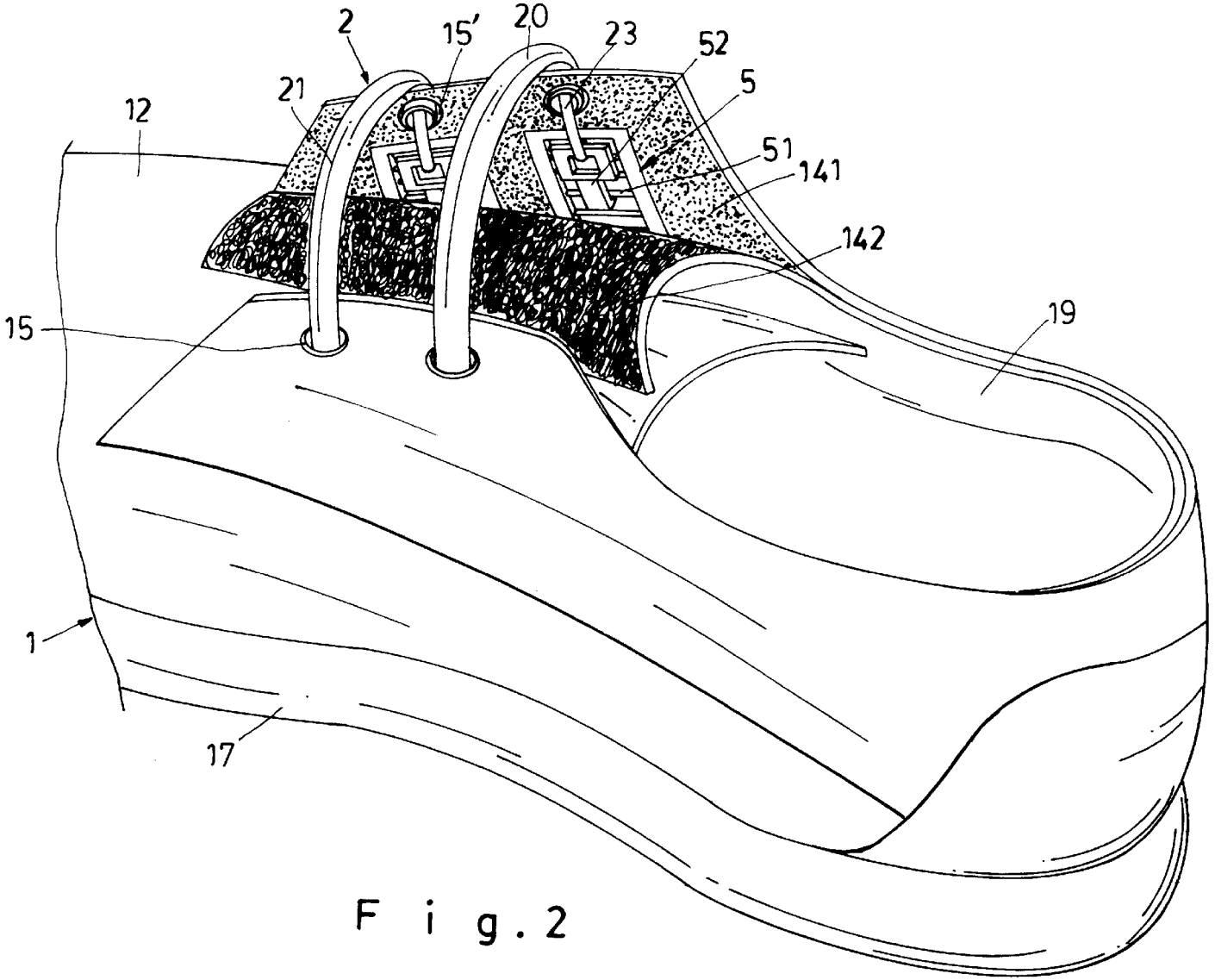
FIG. 2 is a perspective view of the adjustment mechanism in the first embodiment of this invention.
Figure 3:
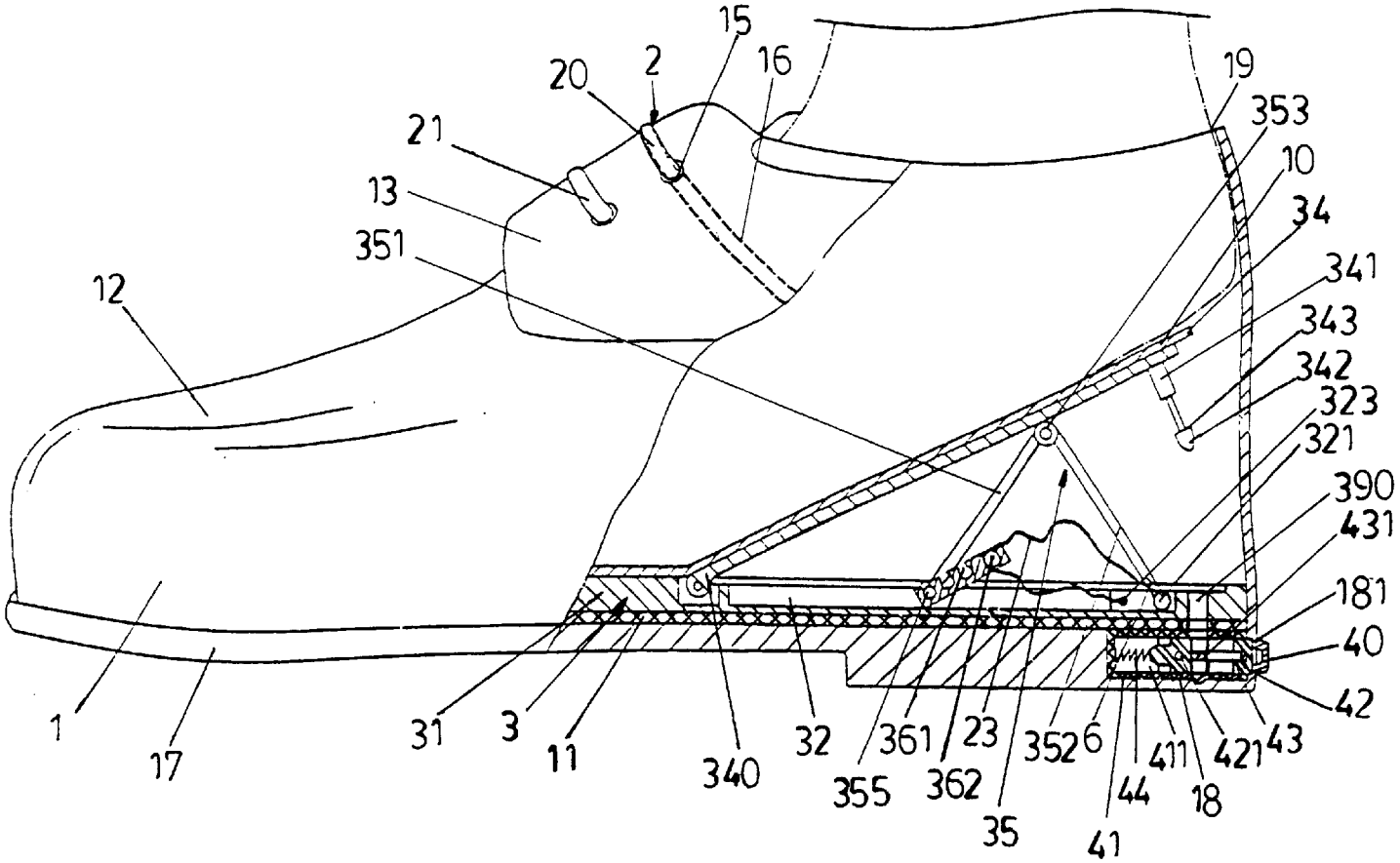
FIG. 3 is a schematic view of the first embodiment of this invention as it is assembled before use.
Figure 4:
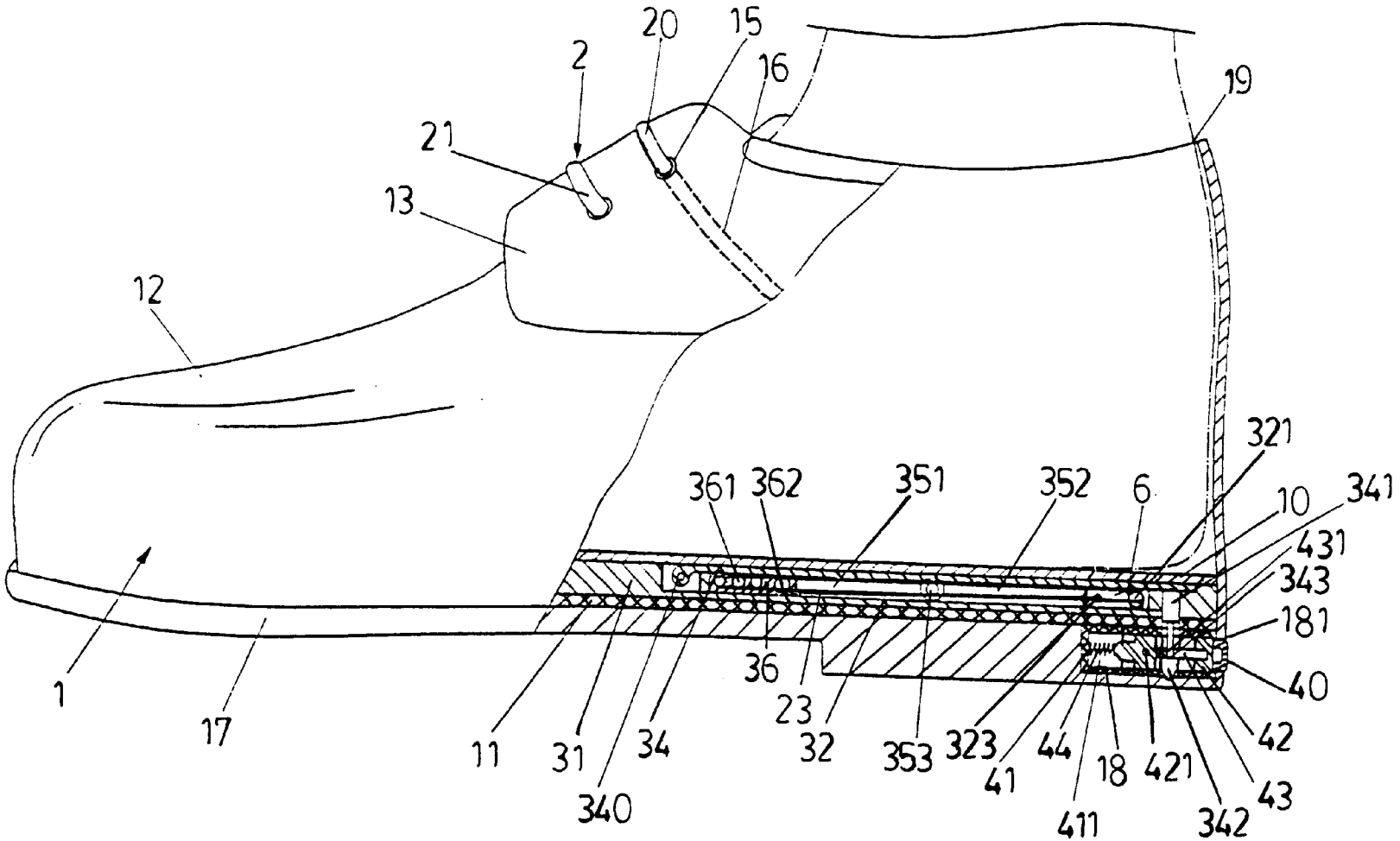
FIG. 4 is a side section view of the first embodiment of this invention as it is put on a foot.
Figure 5:
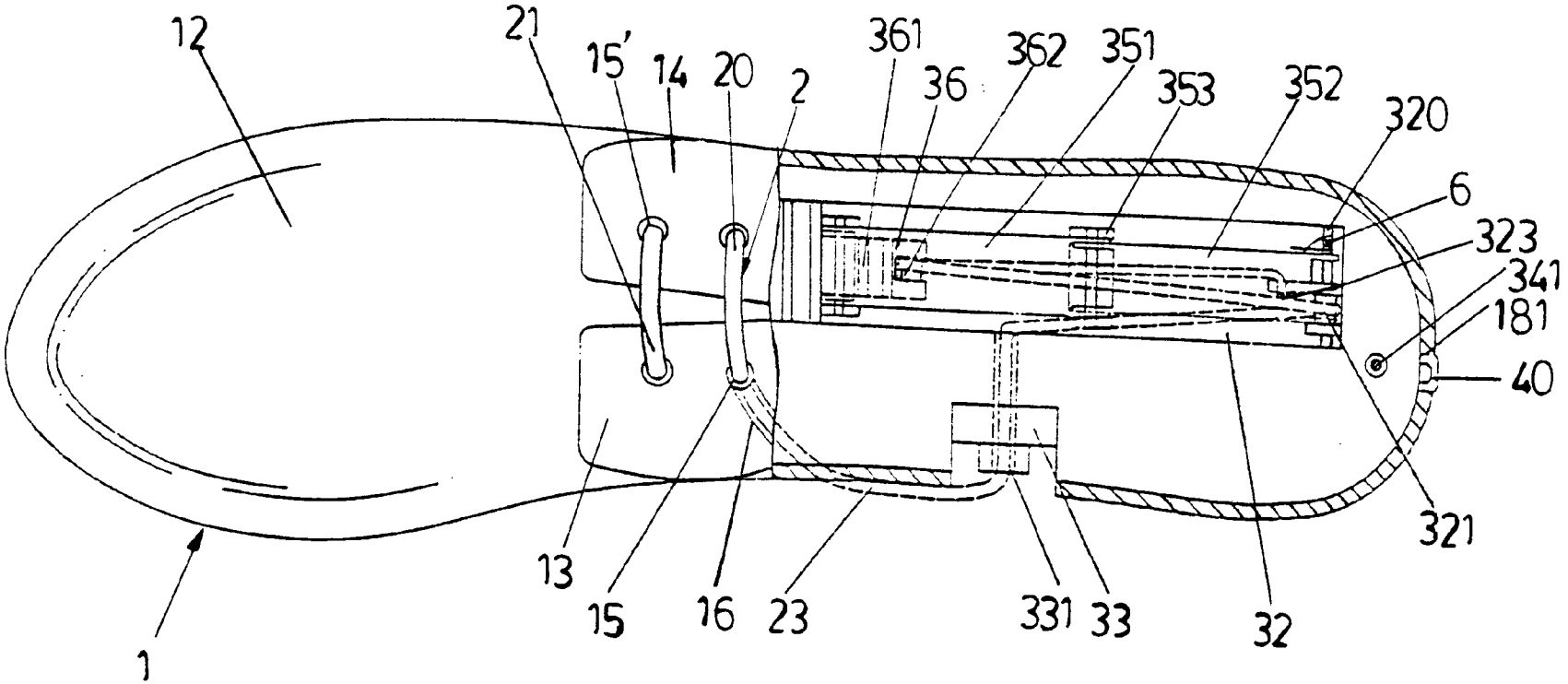
FIG. 5 is a top section view of the first embodiment of this invention as it is put on a foot with the shoelace tightened.
Figure 6:
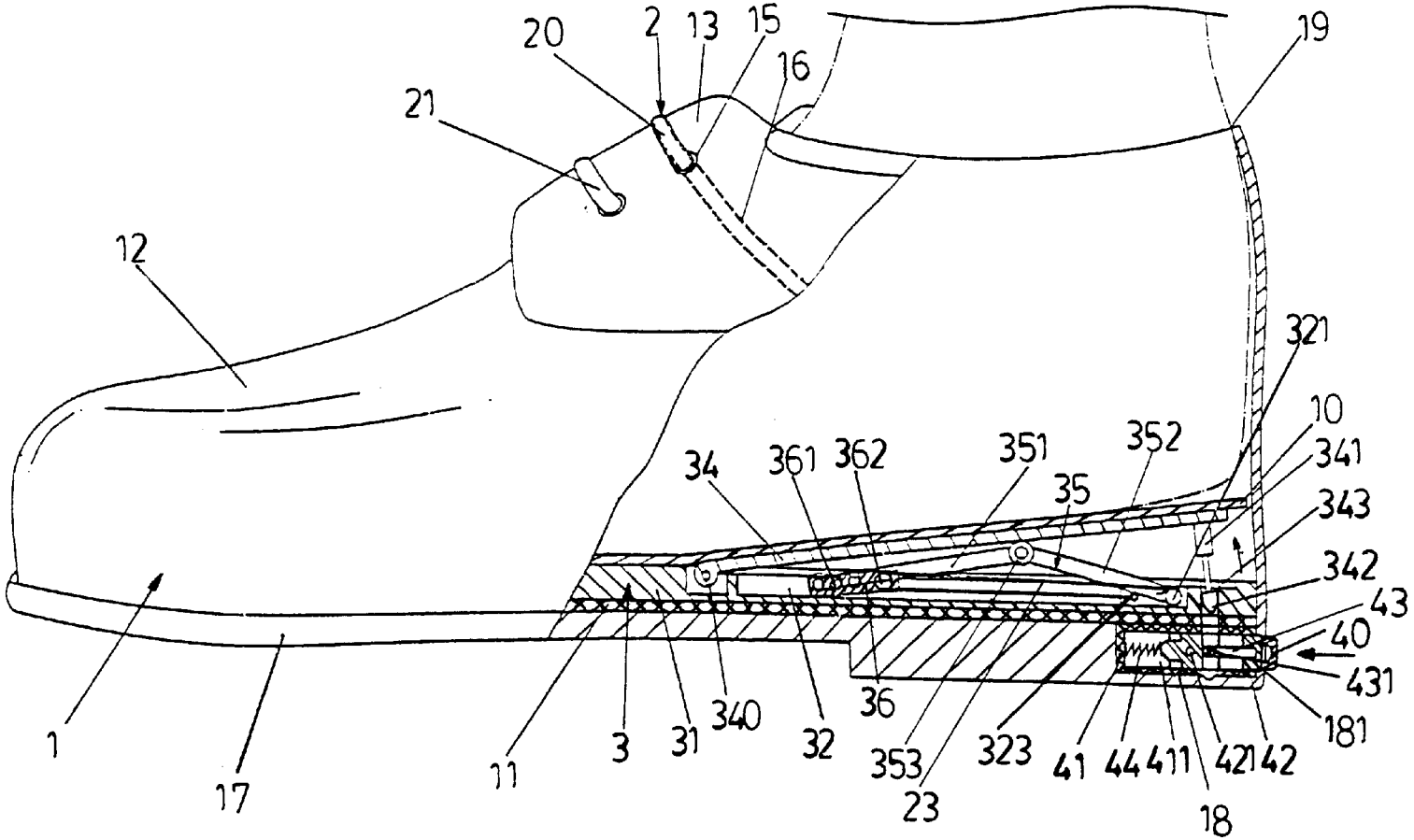
FIG. 6 is a side section view of the first embodiment of this invention as it put off a foot.

Please refer to FIGS. 1 and 2, which are an exploded view and a perspective view of the first embodiment of this invention. This embodiment relates to the pulling, tying and control operation of a single tying component As shown in the drawing, the shoelace involves a mechanism that will automatically tighten when the user is putting the shoe on the foot. By properly modulated design, a variable ratio multiplex mechanism 3 is assembled between a shoe pad 10 and an middle sole 11 of a shoe body 1, in coordination with the shoestring and a tying component 2, from the inside of the shoelace earpiece 13 of the vamp 12, there is at least one piece of laminated cord accommodating channel 16 corresponding the eyelet 15, which is pulled into the shoe body 1 and combined with the variable ratio multiplex mechanism 3 serving as a drive. The operating control to loosen the shoelace when the shoe is pulled off involves a modulated control mechanism 4 inside the control grove 18 on the outsole 17, which works with a button 40 that is installed in a through hole 181 on the rear of the control groove 18 on the outsole 17. The tension of the shoelace and tying component 2 can be adjusted by the adjustment mechanism 5 inside another shoelace earpiece 14 on the vamp 12.

In this embodiment, the shoelace and tying component 2 comprises a decorative shoelace 21 and a tying component 22. In which, the decorative shoelace 21 is a regular decorative and/or elastic shoelace that is pulled parallel on two sides of eyelets 15, 15', the tying component 22 can be composed of a hollow decorative stretch 20 and a shoelace cord 23. The length of the shoelace cord 23 is equivalent to the length to be specified by relative requirements for tightening and loosening processes of the tying component 2. One fixed end of the shoelace cord 23 is fastened to the tension to be tightened by the adjustment mechanism 3 inside the lace earpiece 14. The extended end of the shoelace cord 23 extends from the laminated cord accommodating channel 16 on the tying lace earpiece 13 of the vamp 12 to the modulated sole lamination 31 of the variable ratio multiplex mechanism 3 in the shoe body 1, inserting through the cord guide block 33 into the assembling space 32, winding on the slide part 321 at the rear of the operating space groove 32 and the slide part 362 of the pulling plate 36, then tied on the tightening point 323 at the rear of the assembling space 32 of the sole lamination 31, forming a variable ratio multiplex cord winding unit, that can be depressed by the pressing plate 34, and pulled in the shoe body 1 for variable ratio traction of tightening process and tightening of shoelace to suit the process of putting on the shoe.

The variable ratio multiplex mechanism installed between the shoe pad 10 and the middle sole 11 of the shoe body 1 is composed of the following:

A modulated sole lamination 31, easily assembled between the middle sole 11 and the shoe pad 10, at the end of the sole lamination 31 is at least an assembling space groove 32. In the space inside the rear groove of this assembling space groove 32 is a support post 320 and a slide member 321, the slide member 321 can be a pulley or a shaft. On the end face of the sole lamination 31 and opposite the control groove 18 of the outsole 17 is a hollow channel 390, to enable the insert member 341 of the pressing plate 34 inserting in the control groove 18. In the neighboring assembling space groove 32 is inserted a cord guide block 33, with a cord insert hole 331 that communicates with the assembling space groove 32;

A pressing plate 34, its joining end 340 directly joined to the hinge 322 located at the assembling space groove 32 of the sole lamination, and under normal condition is pressed by a curve arm 35 to curl up, at the bottom of the pressing plate 34 is an insert member 341 with its end formed as a snap head 342, that is depressed when the pressing plate 34 is in a wearing condition, so the insert member 341 can pull through the hollow channel 390 of the sole lamination 31, and installed in the control mechanism 4 in the control groove 18 of the outsole 17;

The curve arm 35 is vertically aligned to the pressing plate 34 and assembled in the assembling space groove 32, connected by a front and a rear arm levers 351, 352, specified in the pressing plate 34 position, and on two sides of the joining end is a slide member 353 (which can be a roller or bearing or direct formation of a round shape), to reduce friction when the pressing plate 34 is pressing down. The curve arm 35 is hinged by the rear end 354 of the rear arm lever 352 to the assembling space groove 32 and the support post 320 at its rear, and at the hinged position is a flexible member 6 (a twisted spring is used in this embodiment), one end of the flexible member 6 is pressed against the end of the assembling space groove 32, the other end of the flexible member 6 is pressed against the rear arm lever 352, so the curve arm 35 is maintained at its curved status when not subjected to pressure, and it pushes the pressing plate 34 to an angle and ready for action. At the front end of the front arm lever 351 is a snap lever 355, which can be optionally inserted in one of the several snap grooves 361 of a pulling plate 36. meanwhile, on two sides of the snap lever 355 is a slide member 356 (can be a roller or a bearing or directly formed as a round shape) working with the pressing operation of the pressing plate 34, to reduce friction when the curve arm 35 is moving;

A pulling plate 36, installed in the assembling space groove 32, interactive to the curved bow of the curve arm 35, on its end is at least one snap groove 361 to enable the snap lever 355 of the front arm lever 351 of the curve arm 35 to optionally engage with the snap groove 361, by engagement of the snap lever 355 and different snap grooves 361, the tension of the shoelace and tying component 2 can be properly adjusted to suit different user's foot, at the rear of the puling plate 36 is installed a slide member 362, this slide member 321 can be a pulley or a shaft in combination with the slide member 362 at the rear of the assembling space groove 32, winding on said shoelace cord 23, and by winding the shoelace cord 23 on the slide members 321, 362, the shoelace and the tying component 2 will have enlarged flexibility when putting on and off the shoe, and the friction will be small during the pulling process, which is advantageous to putting on and pulling off the shoe; and A modulated control mechanism 4, accommodated in a fixed way in the control groove 18 on the outsole 17, the control mechanism 4 includes a control box 41, in the box is a hollow box space 411, to accommodate a button pushing block 42 and a snap plate 43, in which the snap plate 43 is assembled inside the button push block 42, meanwhile, the snap plate 43 has a snap member 431 extending inwardly, located in the hollow groove opening 420 of the button pushing block 42, said button pushing block 42 coordinate with the slide groove 412 of the control box 41 through a pin shaft 421, and is movably installed in the control box 41, and is assembled with a spring 44 so that under normal conditions it pushes flexibly against the water-resistant button 40, the water-resistant button 4 is assembled in a through hole 181 at the rear wall of the control groove 18, next to the button pushing block 42, the button pushing block 42 can be touched through the water-resistant button 40 to control the button pushing block 42 and the snap plate 43 to move horizontally, to control the pressing plate 34 and the insert member 341 that are pressed by the snap plate 43 through the hollow groove opening 420.

An adjustment mechanism 5 (shown in FIG. 2), assembled inside a tying earpiece 14 of the vamp 12, said tying earpiece 14 has an outer earpiece 141 and an inner earpiece 142, on opposite ends of the two earpieces 141, 142 is a Velcro hook and loop strap for fastening purpose, in an open status, the inner earpiece 142 can be easily torn open toward the inside of the shoe, so the adjustment mechanism 5 is exposed for the adjusting operation. At the inside end of the outer earpiece 141 and opposite the eyelet 15 are several snap grades 51, and at the end of the fixed side of the shoelace cord 23 of the shoelace and tying component 2 is a snap member 52, through the self adjustment and selection of engaging snap grade 51 of the snap member 52, proper tension of tightened shoelace and tying component 2 can be adjusted. Meanwhile, after the adjustment, the inner earpieces 141, 142 are fastened together by Velcro band, so the positioned adjustment mechanism 5 can be securely positioned without loosening. The snap member 52 can select a single shoelace cord 23 to tighten, as shown in this embodiment showing a single tying component; or the same snap member 52 can simultaneously be fastened to more than one pieces of shoelace cords 23, as shown in the second embodiment.

FIGS. 3 through 6 illustrate the actual operation of this embodiment.

Under normal conditions when the shoe is laid unused, the curve arm 35 is pressed by the flexible member 6 in a curved state, the pressing plate 34 is pressed by the curve arm 35 to curve upward, and the pulling plate 36 is not pulling on the shoelace cord 23 (shown in FIG. 3) so it becomes a loosened state ready to be worn on the user's foot.

When the user is trying to put on the shoe by inserting the foot in the shoe opening 19, then the user's heel will apply a downward pressing force on the pressing plate 34, and the downward pressing force and angle variation of this pressing plate 34 will cause the curve arm 35 to simultaneously spread downward, which in turn drive the pulling plate 36, causing the assembling space groove 32 to move forward horizontally (shown in FIG. 4), through the pulling shoelace cord 23 of the pulling plate 36, and pulled through the laminated cord accommodating channel 16 to the assembling space groove 32 inside the shoe, then one end of the shoelace cord 23 is fixed onto the tying point 323 of the assembling space groove 32, in coordination with the winding of the shoelace cord 23 between the slide members 362, 321 at the rear of the assembling space grove 32 and the pulling plate 36, under the puling of the pulling plate 36, the shoelace cord 23 creates the movement of the pulling plate 36 for at least two times of the variable ratio cycle, so the shoelace and tying component 2 pulls the two tying earpieces 13, 14 inwardly to tighten the lace. Then, the insert member 341 at the bottom of the pressing plate 34 pulls through the snap head 342 to the sleeve tube 36 and the hollow channel 390 of the sole lamination 31, into the control groove 18 and into the button pushing block 42 and the hollow groove opening 420 of the control mechanism 4, the snap member 431 of the snap plate 43 is engaged to the shoulder 343 of the snap head 342, so the pressing plate 34 is engaged by the control mechanism 4 when the shoe is worn by the user who is waling, so it will not lift upward and influence the user's walking and wearing, and the flexible member 6 will save the energy required for the untying process (shown in FIG. 5).

To take off the shoe, the user need only press, or touch with the tip of another shoe, on the button 40 of the control mechanism 4 inwardly (shown in FIG. 6), pushing the button pushing block 42 to move in the control box 41, which will drive the snap plate 43 and the snap member 431 to shrink inwardly and disengage the insert member 341. Then along with the pulling of the leg out of the shoe opening 19, accompanied by the energy of the flexible member 6 that pushes the curve arm 35 to push the pressing plate 34 to lift upward, the pulling plate 36 also loses its forward force and loosens its pulling action to the shoelace cord 23. Therefore, the uplifting force of the leg will pull open the enveloped status of the vamp 12, the tying component 2 and shoelace cord 23 are also pulled out of the shoe body 1, and reset to their normal condition without the foot in the shoe (shown in FIG. 3), thus achieving the automatic loosening of the shoelace and tying component 2.

Figure 7:
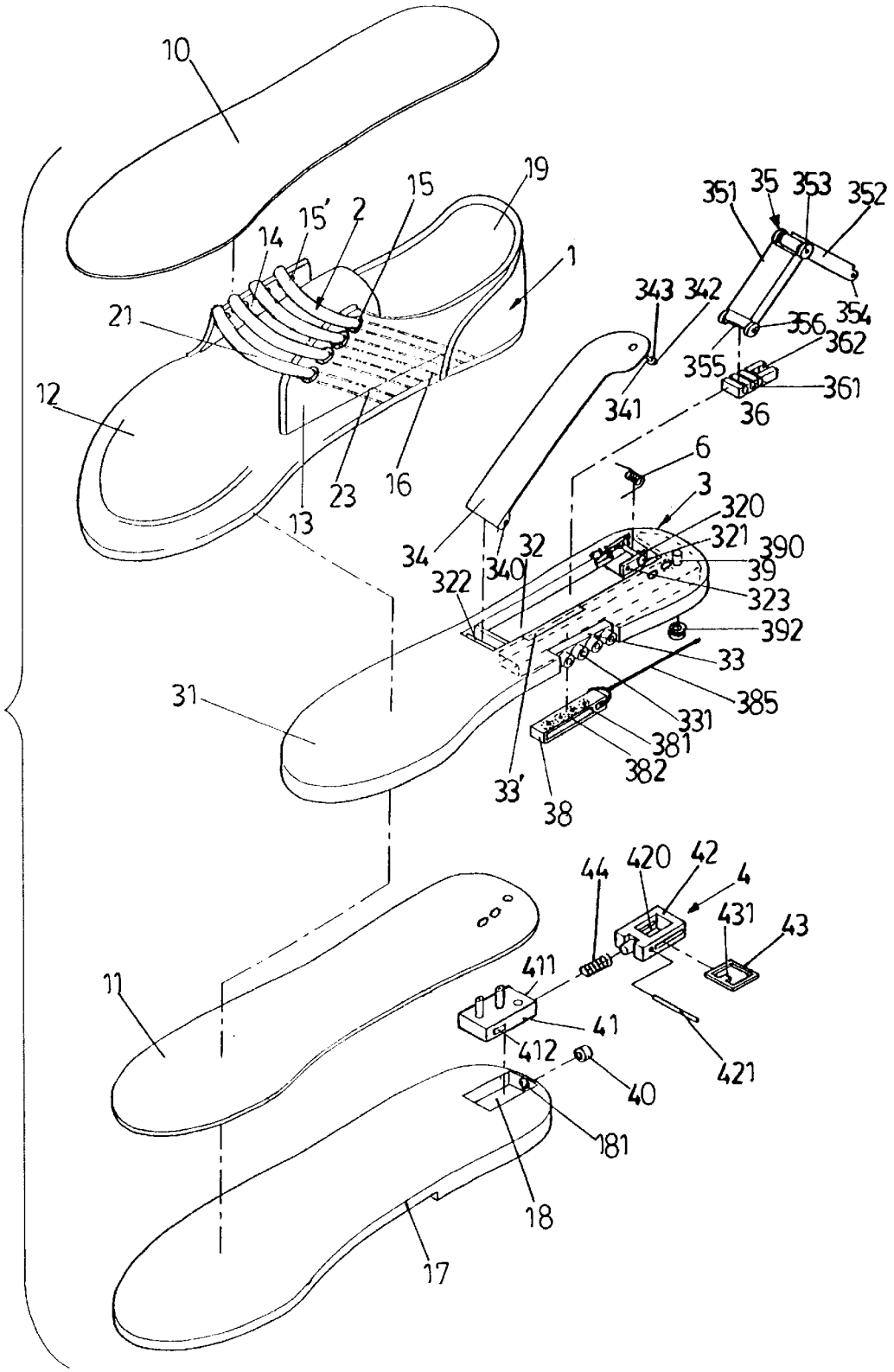
FIG. 7 is an exploded view of the second embodiment of this invention.
Figure 8:
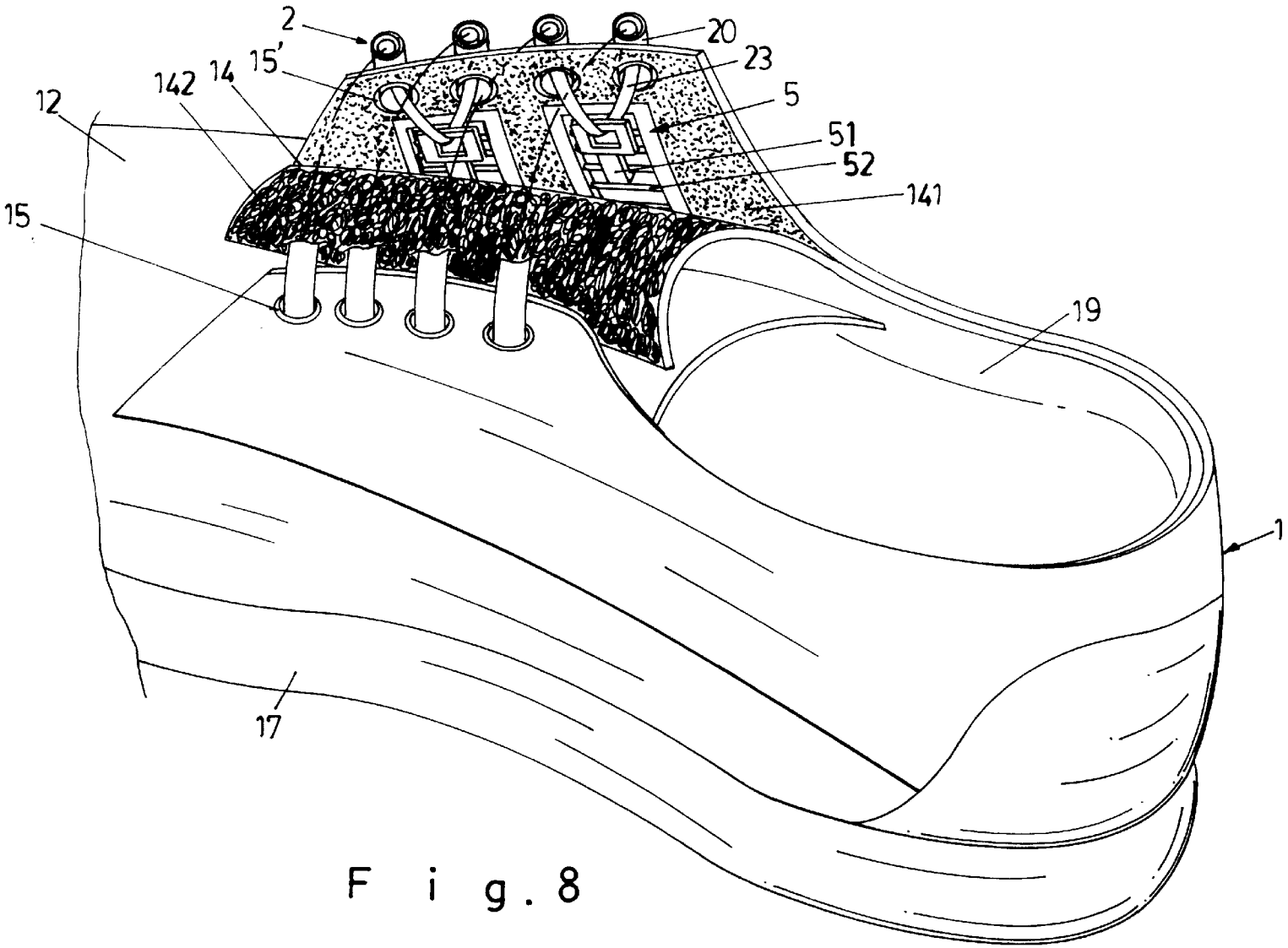
FIG. 8 is a perspective view of the adjustment mechanism in the second embodiment of this invention.
Figure 9:
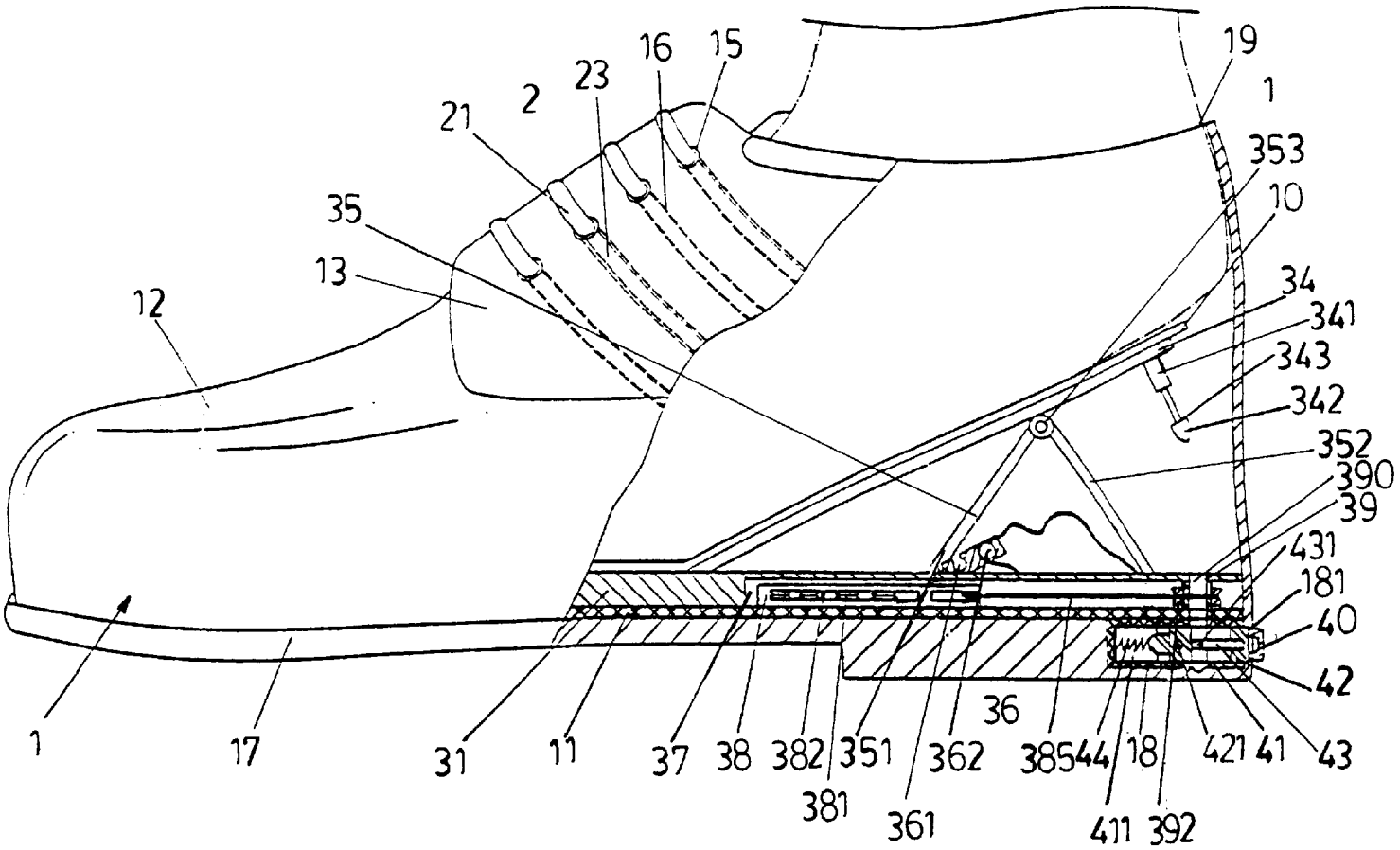
FIG. 9 is a schematic view of the second embodiment of this invention as it is assembled before use.
Figure 10:
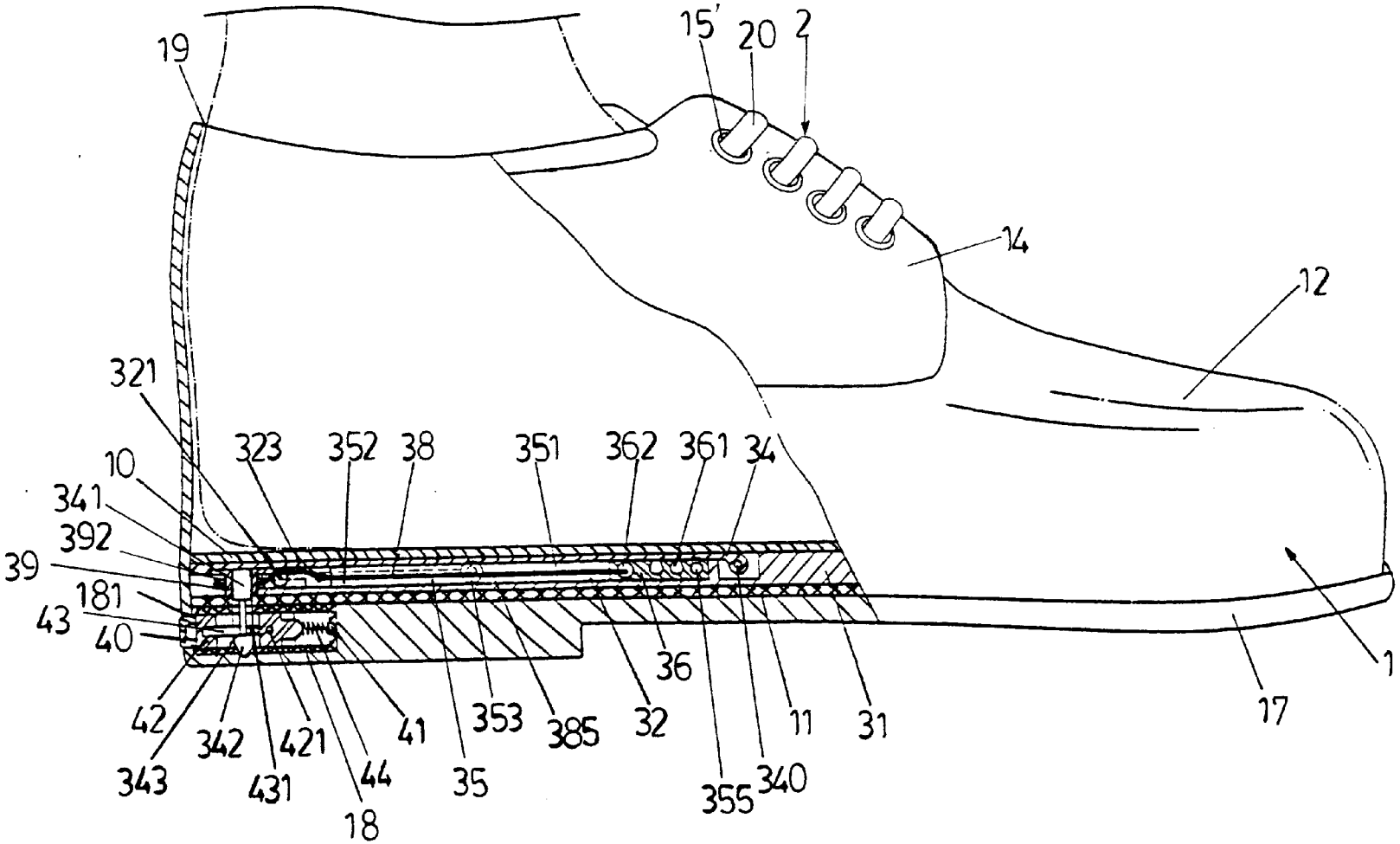
FIG. 10 is a side section view of the second embodiment of this invention as it is put on a foot.
Figure 11:
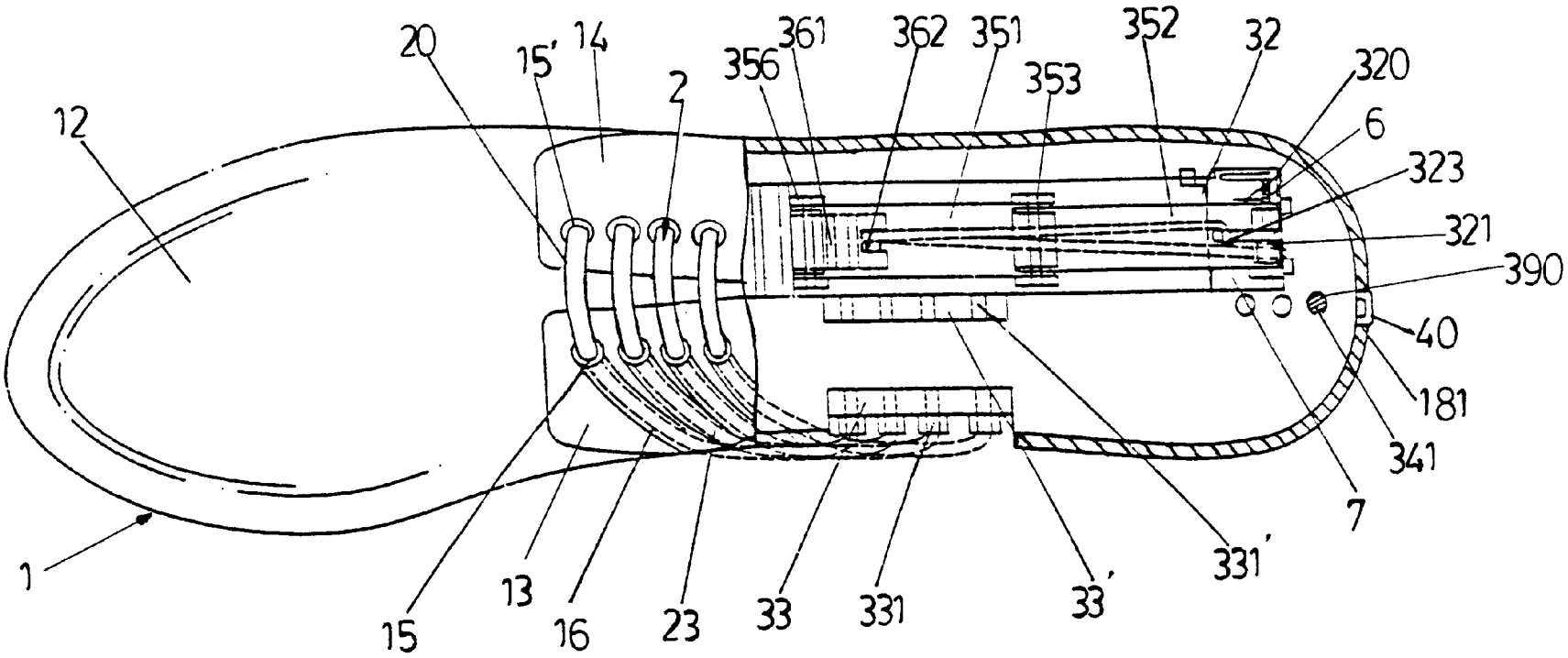
FIG. 11 is a top section view of the second embodiment of this invention as it is put on a foot with the shoelace tightened.
Figure 12:
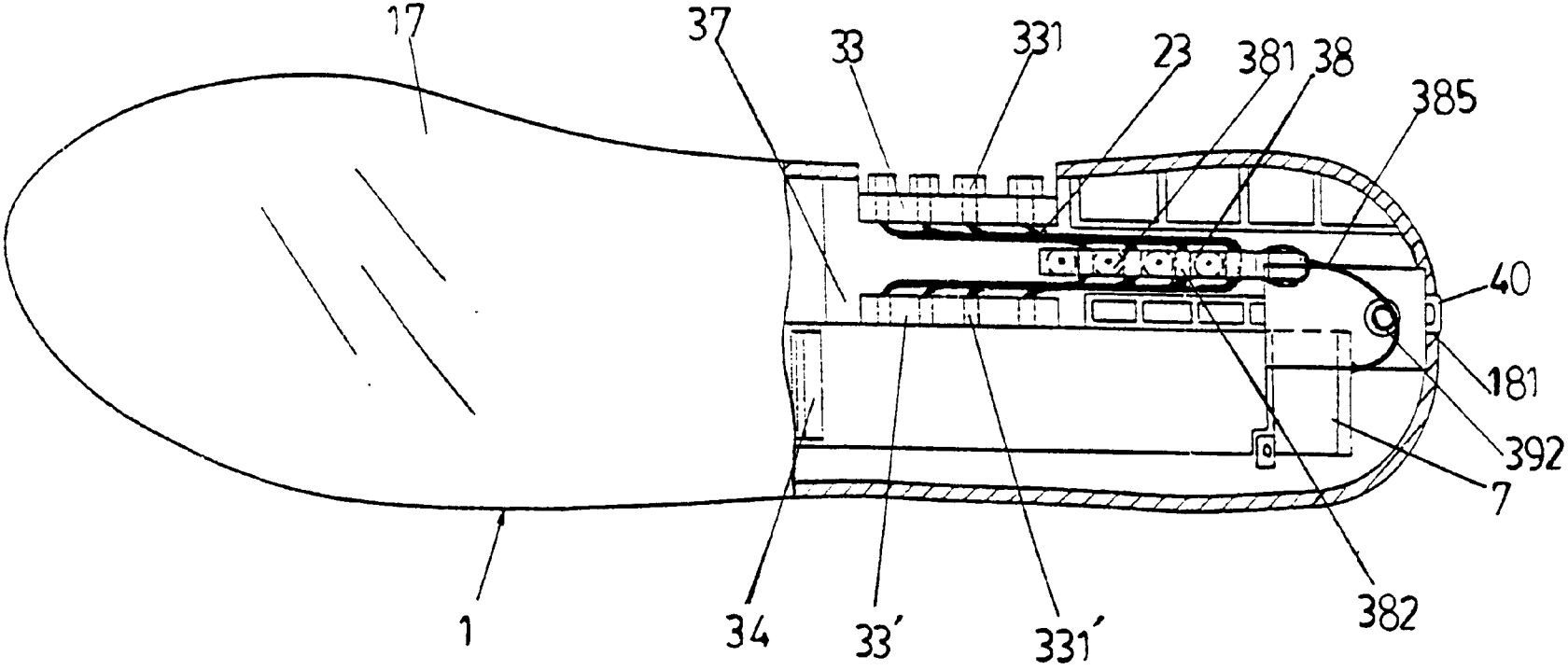
FIG. 12 is a bottom section view of the second embodiment of this invention as it is put on a foot with the shoelace tightened.

Then, please refer to FIGS. 7 through 12, which illustrate the second embodiment of this invention. This embodiment shows the design of multiple shoelaces and tying component 2 to perform the pulling and tying operation:

As shown in FIGS. 7 and 8, which are the perspective views of the second embodiment of this invention. This embodiment explains the control and operation of the multiple tying components. This embodiment of multiple set of shoelaces in synchronization with the process of putting on the shoes on the user's foot is a properly modulated design of variable ratio multiplex mechanism 3, assembled between the shoe pad 10 and the middle sole 11 of the shoe body 1, in coordination with several shoelaces and tying component 2, from the inside of the tying earpiece 13 of the vamp 12, there is at least one laminated cord accommodating channel 16 in relation to the eyelet 15, which is pulled into the shoe body 1 and combined with the variable ratio multiplex mechanism 3 as the drive, and the untying operation in combination with the process of pulling off the shoe involves a modulated control mechanism in the control groove 18 on the outsole 17, with a set of buttons 40 that are exposed at the through hole 181 at the rear wall of the control groove 18 on the outsole 17; the several shoelaces and tying component 2 can be assembled at the adjustment mechanism 5 inside another tying earpiece 14 of the vamp 12 to make the adjustment of tension.

The many sets of shoelace and tying component 2, in this embodiment each independent shoelace and tying component 2 is respectively composed of a decorative shoelace 2 and shoelace cord 23 that is mainly for the tying purpose, the various sets of shoelace and tying component 2 are parallel and winding on two sides and on the parallel shoelace eyelets 15, 15' neighboring each other, the fixed end of each shoelace cord 23 is fastened to the adjustment mechanism 3 inside a tying earpiece 14 to set the tension, and the extended end of the shoelace cord 23 extends from the laminated cord accommodating channel 16 on the tying earpiece 13 of the vamp 12 to the second assembling space groove 37 of the modulated sole lamination 31 in the shoe body 1, and sequentially penetrate the cord inserting hole 311 of the cord guide block 33, and the cord pulling space 382 of a shuttle plate 38, then the end is tied to the cord inserting hole 331' of another cord guide block 33', through the shuttle plate 38 and slide and pull inside the second set of assembling space groove 37, and pulling sequentially inwardly and to tie on the many pieces of shoelace and tying component 2, to perform automatic tightening, or loosening to pull out the shoelace and tying component 2, to automatically loosen the lace;

The variable ratio multiplex mechanism installed between the shoe pad 10 and the middle sole 11 of the shoe body 1 is composed of the following:

A modulated sole lamination 31, easily assembled between the middle sole and the shoe pad 10, on the upper and lower ends of the sole lamination 31 are at least one assembling space grooves 32, 37 that are in staggered positions, in which in the space inside the rear groove of the first assembling side groove 32 are a support post 320 and a slide member 321, the slide member 321 can be a pulley or a shaft, the assembly of the pressing plate 34, the curve arm 35 and the pulling plate 36 will pull the pulling cord 385 of the shuttle plate 38, at the first assembling side groove 37 are installed two matching shapes of cord guide blocks 33, 33', between the two cord guide blocks 33, 33' is a clearance, to assemble a shuttle plate to slide in said clearance, on the side of the two cord guide blocks 33, 33' corresponding to the number of the eyelets 15 is a row of cord inserting eyelets 331, 331', to accommodate the insertion of the shoelace cord 23 of the shoelace and tying component 2 for tightening purpose. At the bottom of the sole lamination 31 and opposite the control groove 18 of the outsole 17 is a downward extension of a sleeve 39, forming a hollow channel 390 to accommodate the insertion of the insert member 341 of the pressing plate 34 into the control groove 18. Meanwhile, on the outside of the sleeve 39 is a slide member 392 (preferably a pulley), to facilitate the winding of the pulling cord 385 of the shuttle plate 38 between two assembling space grooves 32, 37, to reduce friction during the process;

A pressing plate 34, its connecting end 340 directly assembled to the shaft 322 installed at the assembling space groove 32 of the sole lamination, under normal conditions it is pressed by a curve arm 35 to form an angle of curve and ready for wearing process. At the bottom of the pressing plate 34 is an insert member 341 with a snap head 342 at its end, which is depressed when the pressing plate 34 is interacting in wearing process, so the insert member 341 can pull through the sleeve 39 of the sole lamination 31 and the hollow channel 390, and engaged by the control mechanism 4 inside the control groove 18 of the outsole 17;

The curve arm 35 is in vertical alignment with the pressing plate 34 and assembled in the assembling space groove 32, and connected by the front and rear arm levers 351, 352, specified as the pushing pressing plate 34 position, and on two sides of the joining end is a slide member 353 (can be a pulley or a shaft or directly formed in a round shape), to reduce friction when the pressing plate 34 is in the process of pressing down. The curve arm 35 is movably connected by the rear end 354 of the arm lever 352 to the assembling space groove 32 and the support post 320 at its back, and at the connection position is installed a flexible member 6 (a regular twisted spring is used in this embodiment), one end of the flexible member 6 is pressing against the end of the assembling space groove 32, the other end of the flexible member 6 is pressing against the rear arm lever 352, so the curve arm 35 is maintained at a arched height when not subjected to pressure, to press against the pressing plate 34 to curve at an angle and ready for action. The front end of the front arm leer 351 is formed as a snap lever 355, for optional insertion in one of the several snap groves 361 of the pulling plate 36. Meanwhile, at two ends of the snap lever 355 can be installed a slide member 356 (can be a pulley or a bearing or directly formed in a round shape), working with the downward pressing operation of the pressing plate 34 to reduce friction when the curve arm 35 is moving;

A pulling plate 36, installed inside the assembling space groove 32, interactive with the curve arm 35 to move to curve or to press down, on the end is at least one snap groove 361, for engagement by the snap lever 355 of the front arm lever of the curve arm 35 to the snap groove 361 at an appropriate position, by the engagement of the snap lever 355 with different snap grooves 361, aimed at the different size of different users and feet, proper adjustment of the tension of the shoelace and tying component 2 can be made, at the rear of the pulling plate 36 is a slide member 362, this slide member 362 can be a pulley or a shaft, in combination with the slide member 321 at the rear of the assembling space groove 32 to facilitate the winding of the shoelace cord 23, and by means of the shoelace cord 23 winding on the slide members 321, 362, the shoelace and tying component 2 will have enlarged flexibility in the process of putting on and pulling off the shoe, and the friction during the pulling process can be reduced, to facilitate the process of putting on and pulling off the shoe;

A shuttle plate 38, installed in the clearance between two cord guide blocks 33, 33' in the second assembling space groove 37, can slide horizontally, at the side of the shuttle plate 38 is a hollow long groove 380, in side the groove 380 are several pulleys 381 that are spaced at appropriate intervals, forming a pulling cord space 382, respectively for tying and tightening purposes by the cord guide block 33' and the cord inserting hole 331' of the shoelace cord 23, at one end of the shuttle plate 38 is tied a pulling cord 385, this pulling cord 385 extending tout of the rear of the second assembling space groove, winding on the pulley 391 of the sleeve 39 at the rear of the sole lamination 31, entering the first assembling space grove 32, and winding on the slide member at the rear of the groove 32 and the slide member 362 at the rear of the pulling plate 36, then tied to the tying point 323 at the rear of the first assembling space groove 32. Meanwhile, the total length of the pulling cord 362 is approximately the total of twice the length of the curve arm 35 when spread flat and the length of the pulley 391 of the sleeve 39 winding from the first assembling space groove 32 to the second assembling space groove 37, forming the variable ratio transmission and control interactive tying shoelace 2, and the interaction of the shoelace 2 during the process of pulling off the shoe is controlled by the control mechanism 4.

A modulated control mechanism 4, accommodated in the control groove 18 on the outsole 17 of the shoe, the control mechanism 4 including a control box 41, in the box is a hollow box space 411, to accommodate a button pushing block 42 and a snap plate 43, in which, the snap plate 43 is assembled inside the button pushing block 42, meanwhile the snap plate 43 has a snap member 431 that extends inwardly, extending inside the hollow groove opening 420 of the button pushing block 42, the button pushing block 42 coordinates through a key shaft 421 with a slide groove 412 in the control box 4, and is movably installed in the control box 4, assembled with a spring 44, so when under normal conditions it will press flexibly against a water-resistant button 40, the water-resistant button 40 is installed in a through hole 181 at the rear wall of the control groove 18, next to the button pushing block 42, the button pushing block 42 can be touched through the water-resistant button 40, which in turn control the button pushing block 42 and the snap plate 43 to move horizontally, to control and disengage the pressing plate 34 and the insert member 341 that is engaged by the snap plate 43 at the hollow groove opening 420.

An adjustment mechanism 5 (shown in FIG. 8), installed inside a tying earpiece 14 of the vamp 12, said tying earpiece 14 has an outer earpiece 141 and an inner earpiece 142, the opposite sides of the two earpieces 141, 142 are fastened by Velcro fasteners, in a status to be opened, on the inside of the outer earpiece 141 and opposite the eyelet 15 are several snap grades 51, at the fixed end of the shoelace cord 23 of the shoelace and tying component 2 is tied a snap member 52, through self adjustment and selection of the snap grade to be engaged by the snap member 52, the tension can be adjusted by the shoelace and tying component 2. The snap member 52 can select a single shoelace cord 23 to tie; or a snap ember 52 can simultaneously be tied to more than one shoelace cord 23, as in the second embodiment shown in FIG. 8.

The operation of this embodiment is shown in FIGS. 9 through 12.

When the shoe is laid unused, the curve arm 35 is pressed by the flexible member to become a curved status, the pressing plate 34 is pressed by the curve arm 35 to lift up, and the pulling plate 36 does not pull on the pulling cord 385 and the shuttle plate 38 (shown in FIG. 9), so it is in a loosened status and ready to be worn.

When the user tries to put on the shoe and insert the leg into the shoe through the shoe opening 19, the hell of the foot will push down on the pressing plate 34 , this pressing plate 34 is pressed down to change an angle, causing the curve arm 35 to synchronously spread down, which in turn synchronously drives the pulling plate 36 to spread forward and horizontally inside the assembling space groove 32 (shown in FIG. 10), then it pulls the pulling cord 385 through the pulling plate 36, and the shuttle plate 38 starts to slide horizontally inside the assembling space groove 37, then the cord pulling space 382 of the shuttle plate 38, working with the pulley 381, sequentially pulls the multiple pieces of shoelace cords 32 inside the assembling space groove 37, the winding of the pulling cord 385 working with the moving and pulling process of the pulling plate 36, so the pulling cord 385 causes the pulling plate 36 to move at least two times the variable ratio movement cycles, the shuttle plate 38 transmit the control to the shoelace and tying component 2 to pull the two tying earpieces 13, 14 inwardly to become tightened status. Then, the insert member 341 at the bottom of the depressing pressing plate 34 enters the control groove 18, through the snap head 342 and the sleeve 39 of the sole lamination 31 and the hollow channel 390, into the button pushing block 42 and the hollow groove opening 420 of the control mechanism, the snap member 431 of the snap plate 43 is justly engaged to the shoulder 343 of the snap head, so the pressing plate 34 is engaged by the control mechanism 4 when the shoe is worn and the user is walking, and will not lift upward to influence the user's traveling and wearing comfort, and the flexible member 6 will save the energy required for untying process (shown in FIG. 11).

To take off the shoe, the user need only press, or touch with the tip of another shoe, on the button 40 of the control mechanism 4 inwardly (shown in FIG. 12), pushing the button pushing block 42 to move in the control box 41, which will drive the snap plate 43 and the snap member 431 to shrink inwardly and disengage the insert member 341.

Then along with the pulling of the leg out of the shoe opening 19, accompanied by the energy of the flexible member 6 that pushes the curve arm 35 to push the pressing plate 34 to lift upward, the pulling plate 36 also loses its forward force and loosens its pulling action to the shoelace cord 385, relatively it also loosens the pulling force of the shuttle plate 38 on the shoelace cord 23. Therefore, the uplifting force of the leg will pull open the enveloped status of the vamp 12, the tying component 2 and shoelace cord 23 are also pulled out of the shoe body 1, and reset to their normal condition without the foot in the shoe (shown in FIG. 9), thus achieving the automatic loosening of the shoelace and tying component 2.

In the above two embodiments, to facilitate production and assembly, the regional structures of the support post 320, the slide member 321 and the tying point 322 at the rear of the modulated sole lamination 31, which are not conveniently produced and assembled, can be independently assembled on an insert block 7. During the assembling process, all units can be assembled on relative positions on the assembling space grooves 32, 37 of the sole lamination 31 and the insert block 7, the insert block 7 can be fixed on the relative position on the first assembling space groove 32, so that the whole component is more modulated, and the assembly and production can be made easier for mass production.

Figure 13:
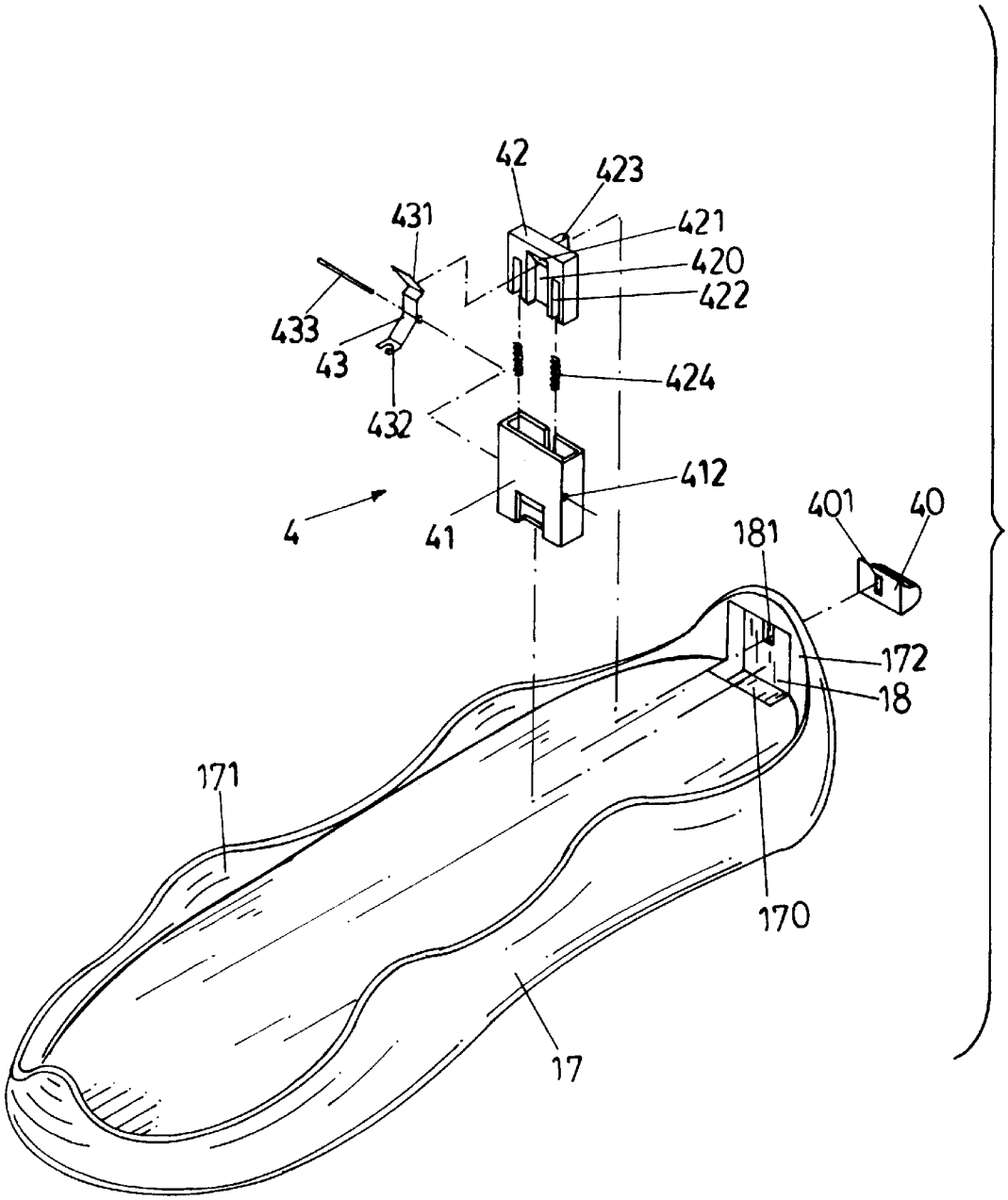
FIG. 13 is a schematic exploded view of the control mechanism in another embodiment of this invention.
Figure 14:
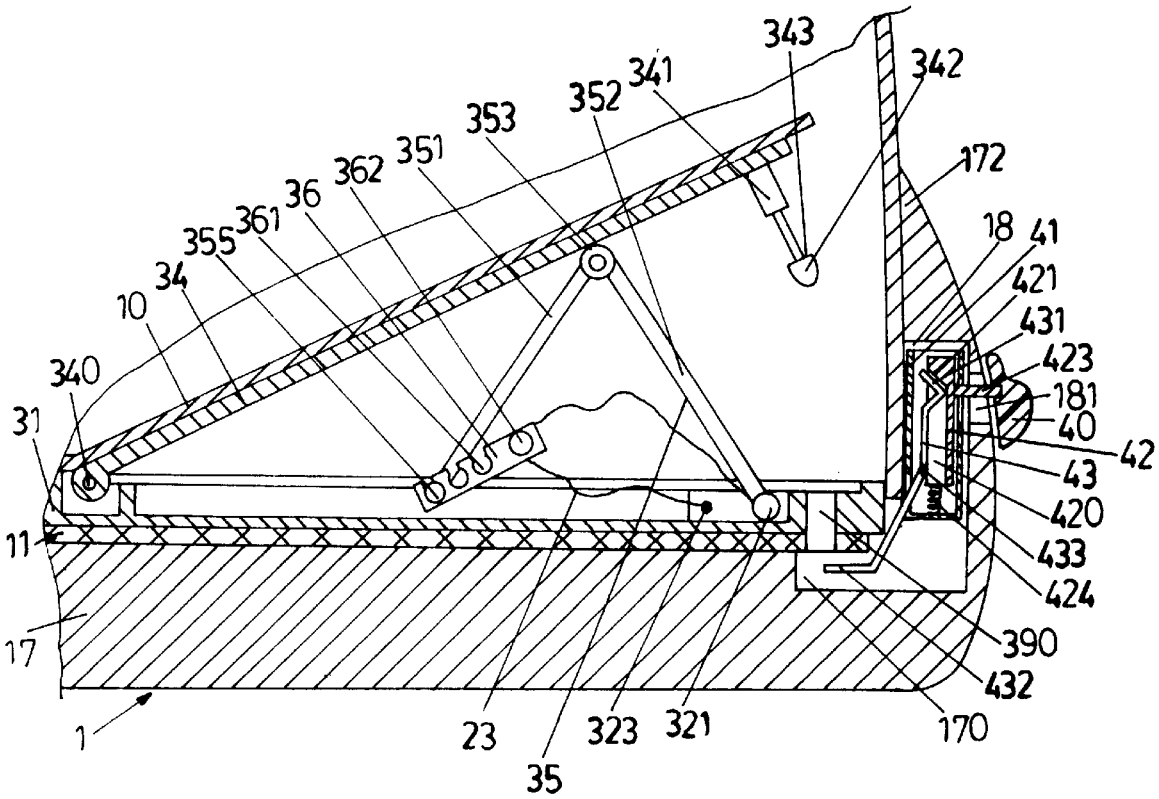
FIG. 14 is a section view of the structural assembly, as it is unengaged, of the control mechanism in another embodiment of this invention.

Please refer to FIGS. 13 through 16, which relate to another embodiment of the control mechanism 4 in this invention. This embodiment is designed to prevent unwanted activation to untie the shoe that may be kicked by others, o ra shoe having a surrounding protective block at the rear of the shoe (such as the sports shoes, etc.);

Please refer to FIGS. 13 and 14, which illustrate another embodiment of the control mechanism 4 of this invention. This embodiment has a longitudinal control to the control mechanism 4, as shown in the drawing, in this embodiment, surrounding the outsole 17 is a supportive protection block 171, the modulated control mechanism 4 is installed in the control groove 18 in the surrounding protection block 172, the button 40 is used for control, at the end face of the outsole 17 and opposite the pressing plate 34 and the insert member 341 is an accommodating groove 170, to accommodate the insert member 341 and snap head 342 when the control mechanism 4 is engaged.

The control mechanism 4 is fixed and accommodated in the control groove 18 at the surrounding protection block 172 and the outsole 17, the control mechanism 4 includes a control box 41, in the box is a hollow box space 411, to accommodate the assembly of a button pushing block 42 and a snap plate 43, in which the snap plate 43 having a pin shaft 433 is connected to a pin hole 412 in the control box 41 to become the shaft that can be inclined at an angle and positioned in the control box 41, the snap plate 43 includes a forward inclined clamping snap 432, that extends to the accommodating groove 170 of the outsole through the front hole 411 of the control box 41, and fixed by the insert member 341 pressing down to fasten; and a push part 431, having a tapered face matching a push control area 421 of a button pushing block 42 for assembly and control; a button pushing block 42 that can slide inside the control box 41, on the end face is a depressed groove 420 and at least one spring 422, the top of the depressed groove 420 is tapered to become a push control area 421, to perform pressing control to match the push part 431 of the snap plate 43, so the angle variation of the snap plate 43 will disengage the insert member 341, in the spring groove 420 is at least a spring 424, the spring 424 pressing inside the control box 41 serving as the energy for the pressing and resetting function of the button pushing block 42, on another end face of the button pushing block 42 is the extension of an insert block 423 accommodating a water-resistant button 40, the water-resistant button 40 is assembled in the through hole 181 at the rear wall of the control groove 18, positioned next to the button pushing block 42, it can be touched through the water-resistant button 40 to longitudinally activate the button pushing block 42, which in turn control the longitudinal movement of the button pushing block 42 and the snap plate 43, to control the pressing plate 34 and the insert member 341 that are engaged by the snap plate 43 into the accommodating groove 170.

Figure 15:
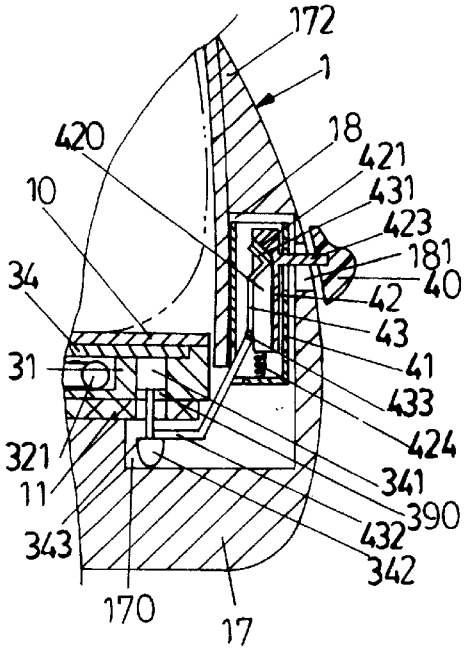
FIG. 15 is a section view of the structural assembly, as it is engaged, of the control mechanism in another embodiment of this invention.
Figure 16:
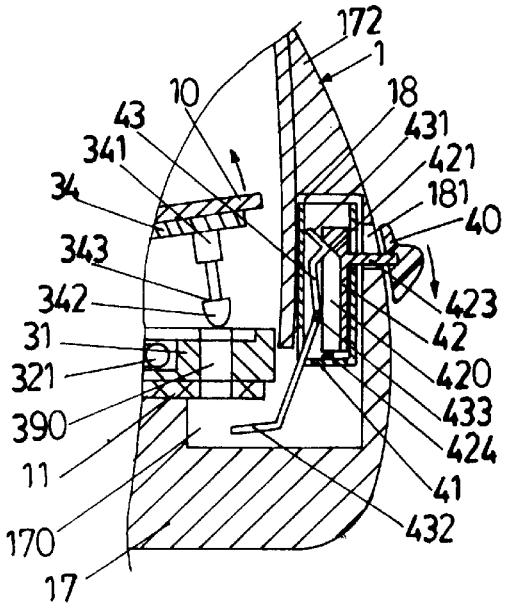
FIG. 16 is a section view of the structural assembly, as it is disengaged, of the control mechanism in another embodiment of this invention.

The actual operation of the control mechanism 4 is shown in FIGS. 14 to 16. When the user is wearing the shoe (shown in FIG. 14), the pressing plate 34 is pressed down, this downward movement and angle variation of this pressing plate 34 will drive the curve arm 35, the pulling plate 36 and the shoelace cord 23 or the pulling cord 385 to pull interactively, pulling the shoelace and tying component 2 and two tying earpieces 13, 14 to pull inwardly and tighten the lace. Then, the insert member 341 at the bottom of the downward moving pressing plate 34 inserts from the snap head 342 through the hollow channel 390 of the sole lamination into the accommodating groove 170, matching the snap plate 43 and the clamp snap 432 of the control mechanism 4 to catch on the shoulder 343 of the snap head 342, so the pressing plate 34 is engaged by the control mechanism 4 when the shoe is worn on the user's foot and the user is walking, it will not curve upward to influence the user's movement and wearing comfort (shown in FIG. 15).

To take off the shoe, the user needs only press down longitudinally or align the tip of another shoe to the button 40 of the control mechanism 4 and push it down (shown in FIG. 16), pushing the button pushing block 42 to move down a longitudinal distance inside the control box 41, then the tapered push control area 421 is directly activated along with the push part 431 of the snap plate 43 to push and squeeze, the pin shaft 433 working as a shaft, driving the snap plate 43 to create an angle change, causing the clamp snap 432 to move back, disengaging the insert member 341, and loosen the shoelace and tying component 2 to suit the process of taking off the shoe. After the downward pressing force of the button 40 and the button pushing block 42 is relieved , the depressed spring 424 pushes back, so the button 40 and the button pushing block 42 again reset to their original positions and ready for the next cycle.

To conclude the above description, in this invention, all the units and components are assembled in a single and modulated sole lamination 31, while the control mechanism 4 is also a modulated design and assembled in the control groove 18 of the outsole, so there is no interactive relationship between the outsole 17 and the middle sole 11, so the fixed processing between the outsole 17 and the middle sole 11 can be made just like ordinary shoes for mass production, which means low rate of waste materials and low costs.

What is claimed is:

1. A variable ratio control shoe with automatic tying and untying of shoelaces, including a shoe body and at least one tying component, a modulated variable ratio multiplex mechanism, a control mechanism, and having an adjustment mechanism to perform self adjustment of tension, and comprising:

(a) a shoe body including two tying earpieces of a vamp, a first tying earpiece corresponding to an end of a tying component and being laminated to form the adjustment mechanism, a second tying earpiece having an inside lamination in combination with an eyelet and at least one laminated cord accommodating channel communicating with the modulated variable ratio multiplex mechanism assembled between a middle sole and a shoe pad, an extended end of the shoelace and tying component extending from the cord accommodating channel into the shoe body to connect with the modulated variable ratio multiplex mechanism as its drive, a rear of an outsole having a control mechanism;

(b) a tying component, comprising a decorative shoelace and a shoelace cord intertwined, a fixed end of said shoelace cord inserted in the second earpiece inside lamination, to adjust a tying tension, an extended control end of the shoelace cord extending from the laminated cord accommodating channel into the shoe body, to the variable ratio multiplex mechanism;

(c) a variable ratio multiplex mechanism installed between the shoe pad and the middle sole of the shoe body, and including:

a modulated sole lamination, assembled between the middle sole and the shoe pad, an end face of the modulated sole lamination having at least one assembling space groove, a cord guide block installed adjacent to and communicating with a moving space, at rear inside the space groove having rows of support posts, slide members and tying spots;

a pressing plate, connected to the assembling space groove of the modulated sole lamination, at a bottom of the pressing plate and a rear of a curve arm is pressed an insert member with an end formed as a snap head, the pressing plate being pressed by a user's foot, through an open hole aligned with the hollow channel of the sole lamination and middle sole, and engaged by the control mechanism inside the control groove of the outsole;

the curve arm, installed at a position aligned to the pressing plate inside the assembling space groove, normally pressed by a flexible member to be curved up, a slide end of the curve arm inserted on a pulling plate, a slide member of the pulling plate working with the slide members at the rear of the assembling space groove and the tying spots to wind the shoelace cord, forming the variable ratio control tying of shoelace; and a control mechanism, aligned with an insert member and assembled in a control groove of a sole, at a rear of the control groove is a through hole for a button, to push the snap plate inside the control box, to control the insert member to engage it when the shoe is put on and disengage it when the shoe is taken off.

2. The variable ratio control shoe with automatic tying and untying of shoelaces as claimed in claim 1, wherein said shoelace cord is wound in the variable ratio multiplex mechanism, one end of the extended shoelace cord being inserted from the cord guide block into the assembling space groove, around the slide member at the rear, extending forward around the slide member of the pulling plate, then extending to the rear of the assembling space groove and tied on the tying spot, whereby repeated processes of putting on the shoe cause the curve arm to move the pulling plate.

3. The variable ratio control shoe with automatic tying and untying of shoelaces as claimed in claim 1, wherein the curve arm of the variable ratio multiplex mechanism has a front and a rear arm levers that are connected at ends, a rear end of the rear arm lever being movably connected to the support post at the rear of the assembling space groove, said movable connection being a flexible member, and a front end of the front arm lever having a movable end forming a snap lever inserted into one of the snap grooves of the pulling plate.

4. The variable ratio control shoe with automatic tying and untying of shoelaces as claimed in claim 3, wherein the curve arm has respective slide members on the connecting end of the front and rear arm levers and on two sides of the front lever slide end, to reduce friction when the curve arm is in movement.

5. The variable ratio control shoe with automatic tying and untying of shoelaces as claimed in claim 3, wherein a flexible member of said variable ratio multiplex mechanism is assembled at the joint between the rear end of the curve arm and the assembling space groove, a first end of the flexible member pressing against a bottom face of the assembling space groove, a second end pressing against the rear arm lever of the curve arm, so the curve arm is kept at a curved height when not subjected to pressure, thereby lifting the pressing plate at an angle so as to be ready for the next process, the flexible member comprising a twisted spring.

6. The variable ratio control shoe with automatic tying and untying of shoelaces as claimed in claim 3, wherein a pulling plate of said variable ratio multiplex mechanism is located in the assembling space groove, on an end face is at least one snap groove, whereby the front arm lever of the curve arm and the snap lever of the slide end engage the snap groove to adjust tension of the shoelace and tying component, and at a rear of the pulling plate is a slide member for winding of the shoelace cord.

7. The variable ratio control shoe with automatic tying and untying of shoelaces as claimed in claim 1, wherein slide member at a rear of the variable ratio multiplex mechanism and the slide member of the pulling plate has an arcuate configuration.

8. The variable ratio control shoe with automatic tying and untying of shoelaces as claimed in claim 1, wherein said tying earpieces have inner and outer earpieces, opposite sides of the two earpieces are fastened by hook and loop fasteners, a side of the outer earpiece opposite the eyelet having at least one snap grade, and at a fixed end of the shoelace cord of the shoelace and tying component is a snap member, engaged with the snap grade, to adjust the tightened tension of the shoelace and tying component.

9. The variable ratio control shoe with automatic tying and untying of shoelaces as claimed in claim 8, wherein the snap member is engaged to at least one single shoelace cord.

10. The variable ratio control shoe with automatic tying and untying of shoelaces as claimed in claim 1, wherein said control mechanism is installed in a control groove of an outsole includes a hollow control box, accommodating a button pushing block and a snap member, wherein said snap member is assembled inside the button pushing block, a snap plate having an inward extension positioned in a hollow groove opening of the button pushing block accommodating an insert member, said button pushing block engaged by a pin shaft to a slide groove in the control box with a spring pushing a water-resistant button assembled in a through hole at a rear wall of the control groove, positioned next to the button pushing block, whereby the button pushing block is actuated by the water-resistant button, to control the horizontal movement of the button pushing block and the snap plate, thereby controlling the pressing plate and insert member to untie the shoelace when the shoe is being taken off.

11. The variable ratio control shoe with automatic tying and untying of shoelaces as claimed in claim 1, wherein said variable ratio multiplex mechanism further comprises:

at least one assembling space groove wherein space inside the groove at a rear has a support post, tying spots slide members, and two cord guide blocks in matching shapes, between the two cord guide blocks is a clearance;

a shuttle plate, installed in the clearance for sliding movement, a side of the shuttle plate having a hollow long groove, to accommodate a plurality of partition members, with a pulling space among the partition members, for respective tying of shoelace cord and cord inserting holes, at one end of the shuttle plate is a pulling cord extending out of a rear wall of the assembling space groove, winding to a sleeve to wind the shoelace cord; and at least one set of shoelace and tying components, respectively composed of a decorative shoelace and a shoelace cord a first, fixed end of each shoelace cord engaged to an adjustment mechanism inside a tying earpiece to adjust the tying tension, a second end extending from the laminated cord accommodating channel in the tying earpiece to the second assembling space groove and sequentially penetrating the cord inserting holes of the cord guide blocks, and a pulling space of the shuttle plate, the end tied inside the cord inserting hole of another cord guide block, pulled by the sliding shuttle plate, pulled sequentially inward and tied to several shoelace and tying components for automatic tightening or automatic loosening by pulling outwardly the shoelace and tying component.

12. The variable ratio control shoe with automatic tying and untying of shoelaces as claimed in claim 11, wherein the partition members are installed in the hollow long groove at the side of the shuttle plate are pulleys.

13. The variable ratio control shoe with automatic tying and untying of shoelaces as claimed in claim 11, wherein the two cord guide blocks assembled in the assembling space groove have matching shapes, and on sides of the two cord guide blocks, matching in quantity the number of eyelets, is a row of cord inserting holes for the shoelace cord of the shoelace and tying component.

14. The variable ratio control shoe with automatic tying and untying of shoelaces as claimed in claim 11, further comprising a slide member, to enable the pulling cord of the shuttle plate to wind between the assembling space grooves, and to reduce friction, the slide member preferably comprising a pulley.

15. The variable ratio control shoe with automatic tying and untying of shoelaces as claimed in claim 1, wherein said control mechanism is located in an outsole having a surrounding supportive and protective block, and assembled in a control groove in the surrounding protection block at a rear of the outsole, a rear wall of the control groove having a through hole for a button, a button pushing block and a snap plate.

16. The variable ratio control shoe with automatic tying and untying of shoelaces as claimed in claim 15, wherein the control mechanism includes a hollow control box, accommodating a button pushing block and a snap plate, wherein said snap plate has a pin shaft connected to a pin hole in the control box, a bottom of the snap plate being formed as a forward inclined clamp snap, extending inside an outsole, pressed down and fixed by a matching insert member, and a pushing part having a tapered face, and formed at a top of the snap plate, is a slidable button pushing block in the control box, on an end face being a recess groove and at least one spring groove, the recess groove having a tapered push control area, which presses on the pushing part of the snap plate, and in the spring groove is at least one spring, pressing between the control box and the spring groove to reserve energy for the pressing of the button pushing block, on another end face of the button pushing block is an insert block, a water-resistant button contacting the button pushing block to control the longitudinal pushing movement of the button pushing block.

* * * * *